US007274384B2

(12) United States Patent
Conwell

(10) Patent No.: US 7,274,384 B2
(45) Date of Patent: Sep. 25, 2007

(54) SELF CLEANING THERMAL MEDIA

(75) Inventor: Kevin Conwell, Fairfield, OH (US)

(73) Assignee: Intermec IP Corp., Woodland Hills, CA (US)

( * ) Notice: Subject to any disclaimer, the term of this patent is extended or adjusted under 35 U.S.C. 154(b) by 127 days.

(21) Appl. No.: 10/441,554

(22) Filed: May 20, 2003

(65) Prior Publication Data

US 2004/0017458 A1 Jan. 29, 2004

Related U.S. Application Data

(60) Provisional application No. 60/382,849, filed on May 23, 2002.

(51) Int. Cl.
*B41J 29/17* (2006.01)

(52) U.S. Cl. ..... 347/221

(58) Field of Classification Search ..... 347/171, 347/214, 221; 400/702
See application file for complete search history.

(56) References Cited

U.S. PATENT DOCUMENTS

| | | | | | |
|---|---|---|---|---|---|
| 4,432,830 | A * | 2/1984 | Jue | ..... | 156/384 |
| 5,832,556 | A * | 11/1998 | Eyler | ..... | 15/104.93 |
| 5,926,197 | A * | 7/1999 | Kessler | ..... | 347/171 |
| 6,585,437 | B1 * | 7/2003 | Wiklof et al. | ..... | 400/621 |

FOREIGN PATENT DOCUMENTS

| | | | | |
|---|---|---|---|---|
| JP | 63-114691 | * | 5/1988 | ..... 347/221 |
| WO | WO93/21020 | * | 10/1993 | |

* cited by examiner

*Primary Examiner*—Huan Tran
(74) *Attorney, Agent, or Firm*—Seed IP Law Group PLLC

(57) ABSTRACT

An abrasive cleaning strip is a functional component of a media roll incorporated into the media strip as a header or a trailer. The abrasive cleaning strip is a plastic film coated with 1200 grit aluminum oxide particles. By including the cleaning strip on the media roll, users are provided with automatic print head cleaning. The media can be thermal transfer media, direct thermal media, or linerless thermal media.

6 Claims, 3 Drawing Sheets

SELF CLEANING THERMAL MEDIA

Figure 1:
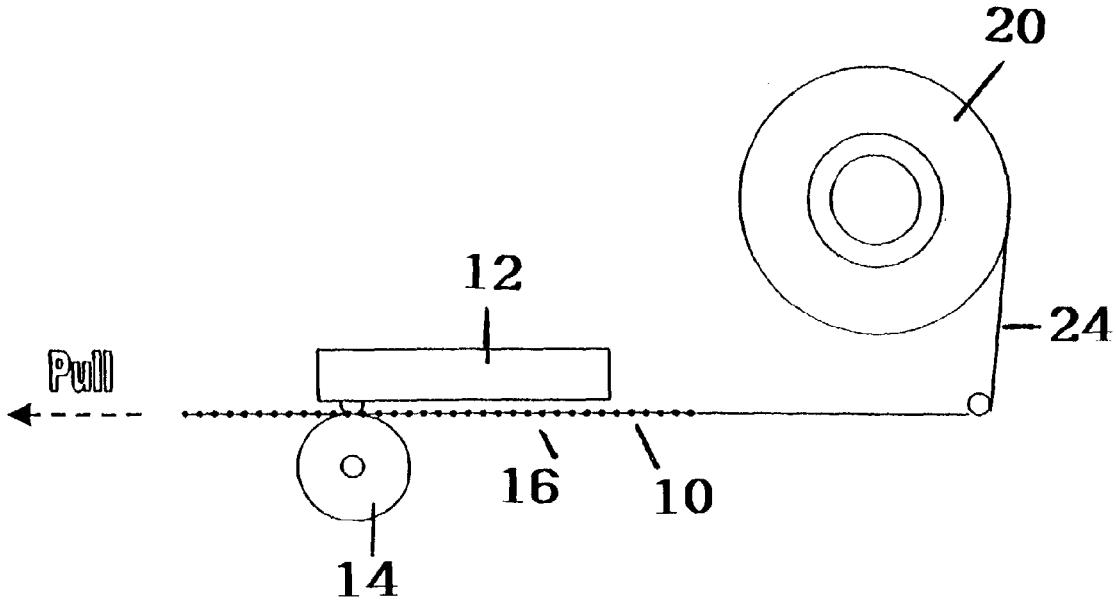

This application claims the benefit of U.S. Provisional Application No. 60/382,849 filed May 23, 2002.

FIELD OF THE INVENTION

The present invention relates to print head cleaning. More particularly it relates to a cleaning strip that is incorporated into the printer media.

DESCRIPTION OF RELATED ART

Several patents exist for thermal print head cleaning cards. One common product is described in U.S. Pat. No. 5,227,226 "Thermal Printer Cleaning Card". A spun bond polyester cloth saturated with isopropyl alcohol is used for removing buildup contamination on thermal print heads. Unfortunately, isopropyl alcohol is not effective at removing "permanent" buildup left behind by the thermal media. Enefco E-Z Strip cleaning cards provide a more reliable method of removing buildup than the 226' cleaning cards. The abrasive cleaning strips are manually applied, requiring an extra printer maintenance operation that needs to be both scheduled and then performed by a designated printer support entity. These abrasive cleaning strips utilize a plastic base film coated with a fine 9 micron (1200 grit) aluminum oxide designed to scrape off built up contamination. Both types of cleaning cards are available as components separate from the printing media. A series of additional steps are necessary for the operator to manually clean a thermal print head with one of these cards.

Different types of print head cleaning technologies have been directly incorporated into printing media. JP5147324 (Kanzaki) describes a method of either impregnating or coating the surface of a ribbon end film with a detergent chemistry that melts away print head contaminants under heat from the thermal head as the ribbon trailer passes under the print head. JP10100454 (Dai Nippon Printing) utilizes abrasive particles mixed into a backcoat layer of a thermal transfer ribbon for scrubbing the print head. U.S. Pat. No. 6,129,019 describes a cloth saturated with turpentine solvent attached to the beginning or end of a roll of labels for automatically cleaning a thermal print head. U.S. Pat. No. 5,458,934 describes a self cleaning roll stock leader or trailer used in combination with an automated solvent dispensing mechanism incorporated into the printer. The solvent is dispensed from a pouch reservoir onto a cleaning strip via feed rollers as it passes under the print head without human intervention.

SUMMARY OF THE INVENTION

Cumulative buildup on the heating elements of a thermal print head will have a negative impact on print quality. Buildup contamination on the heating elements could come from any media component that is in direct contact with the thermal heating elements, for example the backcoat layer on a thermal transfer ribbon, the thermal dye and/or topcoat layer on direct thermal media, or the release layer on linerless media. The buildup insulates the heating element which impedes heat transfer to the printing media. Often users will incur unnecessary cost and printer downtime by mistakenly replacing a failed print head because the commonly used isopropyl alcohol alone will not effectively remove built up contaminants.

This invention incorporates a cleaning strip into a leading and/or trailing portion of a roll of thermal media. By mating the cleaning strip to the media, regular cleaning intervals are achieved which helps to minimize cumulative buildup on the heating elements.

DETAILED DESCRIPTION OF THE FIGURES

Figure 2:
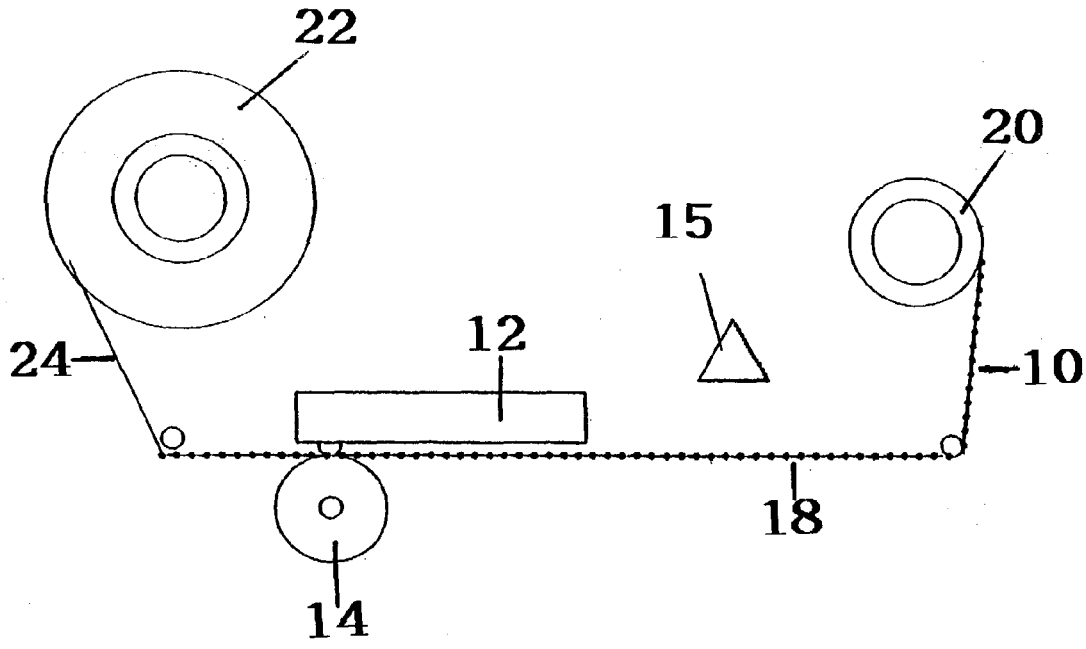
Figure 3:
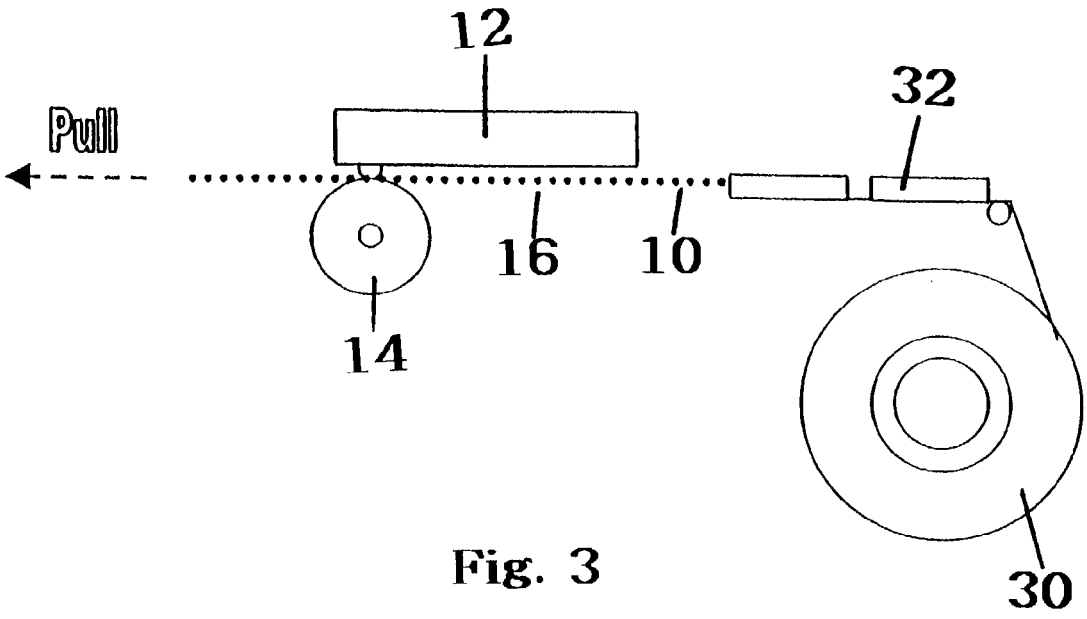
Figure 4:
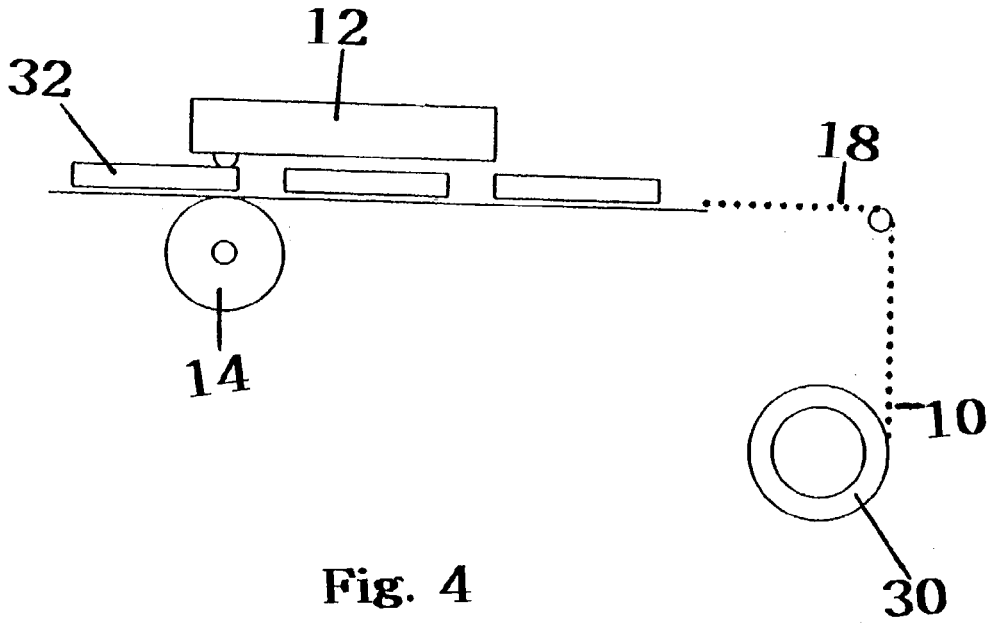
Figure 5:
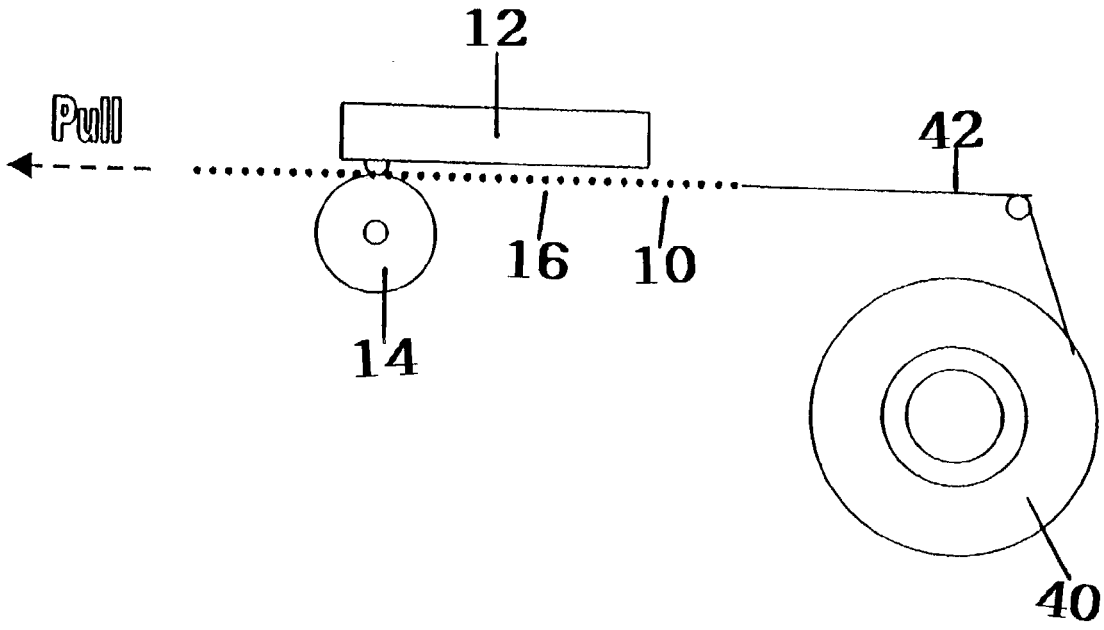

Several embodiments of the invention are shown in the figures:

FIG. 1: Cleaning strip used as a leader tape on a roll of thermal transfer ribbon;

FIG. 2: Cleaning strip used as a trailer tape on a roll of thermal transfer ribbon;

FIG. 3: Cleaning strip used as a leader tape on a roll of direct thermal media;

FIG. 4: Cleaning strip used as a trailer tape on a roll of direct thermal media;

FIG. 5: Cleaning strip used as a leader tape on a roll of self-wound linerless media with adhesive; and FIG. 6: Cleaning strip used as a trailer tape on a roll of self-wound linerless media with adhesive.

DETAILED DESCRIPTION OF THE INVENTION

This invention incorporates a cleaning strip into a roll of thermal media for maintaining a clean print head and preventing cumulative buildup on the thermal heating elements. Therefore, the invention provides users with automatic print head cleaning which occurs with a frequency tied directly to printer usage thereby reducing the costs associated with servicing and replacing "bad" print heads. Preferably, each time a new roll with cleaning strip header is placed on the printer or each time a roll with a cleaning strip trailer is consumed, the print head is automatically cleaned.

Cumulative buildup on the heating elements of a thermal print head will have a negative impact on print quality. Buildup contamination on the heating elements could come from any media component that is in direct contact with the thermal heating elements, for example the backcoat layer on a thermal transfer ribbon, the thermal dye and/or topcoat layer on direct thermal media, or the release layer on linerless media. The buildup insulates the heating element which impedes heat transfer to the printing media. Often users will incur unnecessary cost and printer downtime by mistakenly replacing a failed print head because the commonly used isopropyl alcohol alone will not effectively remove built up contaminants.

As shown in FIGS. 1–6, the use of an abrasive type cleaning strip 10 can be utilized in different types of thermal media, for example: 1) thermal transfer ribbons 24, 2) direct thermal media 32, or 3) linerless thermal media 42. A plastic film coated with fine 9 micron (1200 grit) aluminum oxide particles can be included as a functional component of the media roll 20, 30, 40. The abrasive film strip 10 may be used as a leader 16 at the beginning of a roll and/or as a trailer 18 at the end of a roll. As a leader 16, the film strip 10 may be printed to include a company or product logo, or instructions on how to use the leader strip for cleaning a print head. As a trailer 18, the film strip can be opaque or transparent to function as a means of shutting the printer down as the trailer 18 reaches an optical sensor 15. The trailer 18 is then pulled through the media path from under the closed print head 12 as needed to remove buildup contamination.

FIG. 1 is a thermal transfer ribbon with an abrasive film strip 10 leader 16 incorporated at the beginning of the ribbon supply roll 20. The leader 16 is pulled between the print head 12 and the platen roller 14 to clean the print head 12. The ink film 24 is after the abrasive strip 10 on the ribbon supply roll 20.

FIG. 2 is an alternative embodiment of a thermal transfer ribbon with an abrasive film strip 10. The abrasive film strip is a trailer 18. After the ink film 24 has been used up, the trailer 18 incorporated at the end of the ribbon supply roll 20 can be used to clean the print head 12.

FIG. 3 is a direct thermal media roll 30 with an abrasive film strip 10 leader 16 incorporated at the beginning of the thermal media roll 30. The media 32 can be, for example, labels or tags. The leader 16 is pulled between the print head 12 and the platen roller 14 to clean the print head 12. The media 32 is after the abrasive strip 10.

FIG. 4 is an alternative embodiment of a direct thermal media roll 30 with an abrasive film strip 10. The abrasive film strip 10 is a trailer 18 incorporated after the media 32.

FIG. 5 is a liner less media roll 40 with an abrasive film strip 10 leader 16 incorporated at the beginning of the linerless media roll 40. The leader 16 is pulled between the print head 12 and the platen 14 to clean the print head. The linerless media 42 is after the abrasive strip 10 on the linerless media roll 40.

Figure 6:
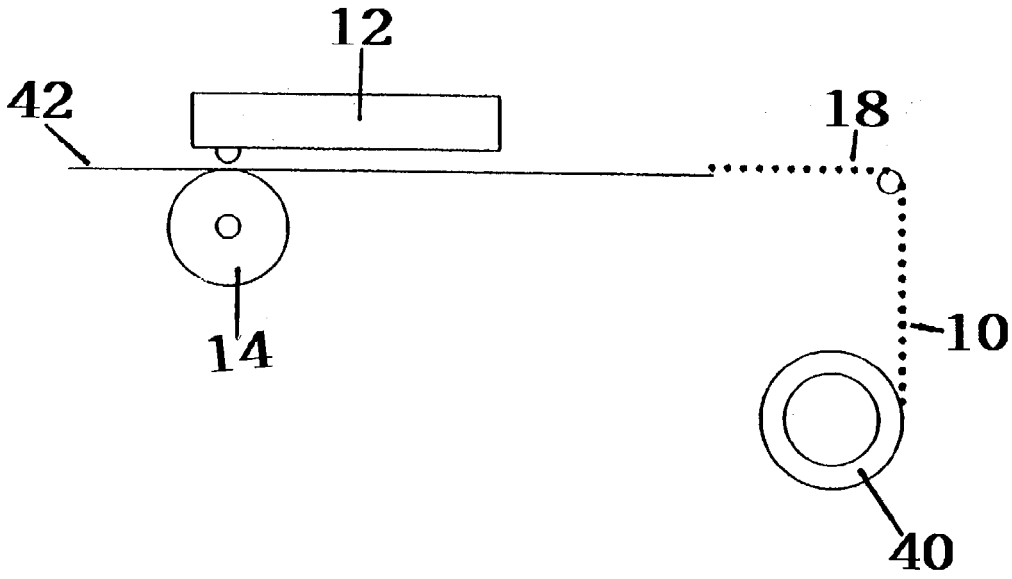

FIG. 6 is an alternative embodiment of a linerless media roll 40 with an abrasive film strip 10. The abrasive film strip 10 is a trailer 18 incorporated after the media 42 at the end of the roll 40.

The invention claimed is:

1. A thermal media roll with an integrated print head cleaning strip comprising:

a media having a front end and a tail end and an abrasive cleaning strip incorporated at the tail end of the media, wherein the abrasive cleaning strip is pulled under the print head to remove buildup, and the abrasive cleaning strip is opaque or transparent and functions as a means of shutting down the printer when the tail end reaches an optical sensor.

2. The thermal media roll of claim 1 wherein the media is selected from the group consisting of thermal transfer ribbon, direct thermal media and linerless thermal media.

3. The thermal media roll of claim 2 wherein the direct thermal media is labels or tags.

4. The thermal media roll of claim 1 wherein the media is labels or tags.

5. The thermal media roll of claim 1 wherein the abrasive cleaning strip is a plastic film coated with aluminum oxide particles.

6. The thermal media roll of claim 5 wherein the aluminum oxide particles are 1200 grit.

* * * * *